US007839340B2

(12) United States Patent
Yamazaki et al.

(10) Patent No.: US 7,839,340 B2
(45) Date of Patent: Nov. 23, 2010

(54) COLLAPSABLE PORTABLE WIRELESS UNIT

(75) Inventors: Yukari Yamazaki, Toyama (JP); Yutaka Saito, Ishikawa (JP); Yoshio Koyanagi, Kanagawa (JP); Hiroshi Katayama, Kanagawa (JP); Tomoaki Nishikido, Ishikawa (JP)

(73) Assignee: Panasonic Corporation, Osaka (JP)

( * ) Notice: Subject to any disclaimer, the term of this patent is extended or adjusted under 35 U.S.C. 154(b) by 202 days.

(21) Appl. No.: 11/587,378

(22) PCT Filed: Apr. 25, 2005

(86) PCT No.: PCT/JP2005/007850

§ 371 (c)(1),
(2), (4) Date: Oct. 24, 2006

(87) PCT Pub. No.: WO2005/104299

PCT Pub. Date: Nov. 3, 2005

(65) Prior Publication Data

US 2008/0018542 A1 Jan. 24, 2008

(30) Foreign Application Priority Data

Apr. 26, 2004 (JP) ..... 2004-130328

(51) Int. Cl.
*H01Q 1/24* (2006.01)

(52) U.S. Cl. ..... 343/702; 343/700 MS; 343/824

(58) Field of Classification Search ..... 343/700 MS, 343/702
See application file for complete search history.

(56) References Cited

U.S. PATENT DOCUMENTS

| | | | | |
|---|---|---|---|---|
| 3,680,128 | A * | 7/1972 | Wille et al. | 343/702 |
| 6,208,302 | B1 * | 3/2001 | Jacob | 343/702 |
| 6,380,896 | B1 | 4/2002 | Berger | |
| 6,628,236 | B2 * | 9/2003 | Kim et al. | 343/702 |
| 2001/0020920 | A1 | 9/2001 | Shigihara | |
| 2004/0090371 | A1 * | 5/2004 | Rossman | 343/700 MS |

(Continued)

FOREIGN PATENT DOCUMENTS

CN 1146142 C 4/2004

(Continued)

OTHER PUBLICATIONS

Supplementary European Search Report dated Oct. 10, 2007.

(Continued)

*Primary Examiner*—Douglas W Owens
*Assistant Examiner*—Jae K Kim
(74) *Attorney, Agent, or Firm*—Dickinson Wright PLLC

(57) ABSTRACT

A collapsable portable wireless unit (100) comprises an upper case (101) and a lower case (102) coupled through a hinge member (103) to open/close freely. A planar conductor (105) is arranged on the upper case (101). First and second power supply sections (111, 112, 103) are arranged on the planar conductor (105) at a specified interval. A harmonic signal distributor (120) is arranged on a circuit board (110) provided in the lower case (102) and distributes a harmonic signal to the first and second power supply sections (111, 112, 103). A phase shifter (121) sets the exciting phase of the harmonic signal in the second power supply sections (112, 103) at a value different from that of the exciting phase of the harmonic signal in the first power supply sections (111, 103).

3 Claims, 8 Drawing Sheets

U.S. PATENT DOCUMENTS

| | | | | |
|---|---|---|---|---|
| 2005/0001773 | A1 * | 1/2005 | Morningstar et al. | 343/702 |
| 2005/0200529 | A1 * | 9/2005 | Watanabe | 343/700 MS |

FOREIGN PATENT DOCUMENTS

| | | | |
|---|---|---|---|
| EP | 1 168 658 | A1 | 1/2002 |
| EP | 1168658 | A1 * | 1/2002 |
| EP | 1383200 | | 1/2004 |
| JP | 2000183635 | | 6/2000 |
| JP | 2000-353911 | | 12/2000 |
| JP | 2000353911 | | 12/2000 |
| JP | 2001230623 | | 8/2001 |
| JP | 2002016433 | | 1/2002 |

OTHER PUBLICATIONS

PCT International Search Report dated Jul. 19, 2005.
Chinese Office Action dated Mar. 1, 2010.

* cited by examiner

COLLAPSABLE PORTABLE WIRELESS UNIT

TECHNICAL FIELD

The present invention relates to a foldable mobile wireless apparatus having GPS receiving functions.

BACKGROUND ART

Foldable mobile phones having an upper case and a lower case connected by a hinge member that connects and able to be opened and closed are widely used in recent years. These foldable mobile phones have started having additional functions of GPS (Global Positioning System) receiving functions. GPS utilizes circularly polarized waves, instead of linearly polarized waves used in mobile phone communication. Accordingly, to have GPS receiving functions and achieve high reception performance, circularly polarized wave antennas for GPS reception need to be mounted in the case of the foldable mobile phone.

Circularly polarized wave antennas for mobile phones are disclosed in, for example, Patent Document 1 and Patent Document 2. The circularly polarized wave antennas disclosed in Patent Document 1 and Patent Document 2 capture circularly polarized waves with cross-bar elements provided in the flip-down covers of the mobile phone. In addition, these circularly polarized wave antennas capture polarized waves appropriately in the state (hereinafter referred to as "calling state") where the user makes a call holding the mobile phone in his hand.

Circularly polarized wave antennas for mobile phones also include the one disclosed in Patent Document 3. The circularly polarized wave antenna disclosed in Patent Document 3 performs polarization diversity operation by switching two cross elements provided inside the mobile phone and supplying power at a phase difference of 90 degrees.

Patent Document 1: Japanese Patent Application Laid-Open No. 2000-183635

Patent Document 2: Japanese Patent Application Laid-Open No. 2000-353911

Patent Document 3: Japanese Patent Application Laid-Open No. 2002-16433

DISCLOSURE OF INVENTION

Problems to be Solved by the Invention

However, conventional foldable mobile phones require multiple antenna elements and feeding cables as circularly polarized wave antennas for mobile phones, which gives problems of complicated configurations and difficulty in miniaturization and thinning.

In order to solve the above problems, it is an object of the present invention to provide a thin, foldable mobile wireless apparatus that does not require complicated configurations formed with multiple antennas and feeding cables for circularly polarized wave antennas for mobile phones, and that provides high antenna performance in the hand-held state.

Another object of the present invention is to provide a thin, foldable mobile wireless apparatus that uses one antenna mounted in the foldable mobile wireless apparatus as a mobile phone antenna and as a circularly polarized wave antenna, and that provides high antenna performance in the hand-held state.

Means for Solving the Problem

A foldable mobile wireless apparatus according to the present invention has an upper case and a lower case, the upper case and lower case being connected by a hinge member and able to be opened and closed, and employs a configuration having: a flat conductor that is provided in the upper case; a first feeding section and a second feeding section that are provided on the flat conductor spaced by a predetermined distance; a circuit board that is provided in the lower case; a harmonic signal distributing section that is provided on the circuit board and distributes a harmonic signal to the first feeding section and the second feeding section; a harmonic signal supplying section that supplies the harmonic signal to the harmonic signal distributing section; and a phase setting section that sets an excitation phase of the harmonic signal at the second feeding section to a different value from an excitation phase of the harmonic signal at the first feeding section.

Advantageous Effect of the Invention

The present invention provides a thin, foldable mobile wireless apparatus that does not require complicated configurations formed with multiple antennas and feeding cables for circularly polarized wave antennas for mobile phones, and that provides high antenna performance in the hand-held state.

BEST MODE FOR CARRYING OUT THE INVENTION

Now, embodiments of the present invention will be described in detail with reference to the accompanying drawings.

First Embodiment

Figure 1:
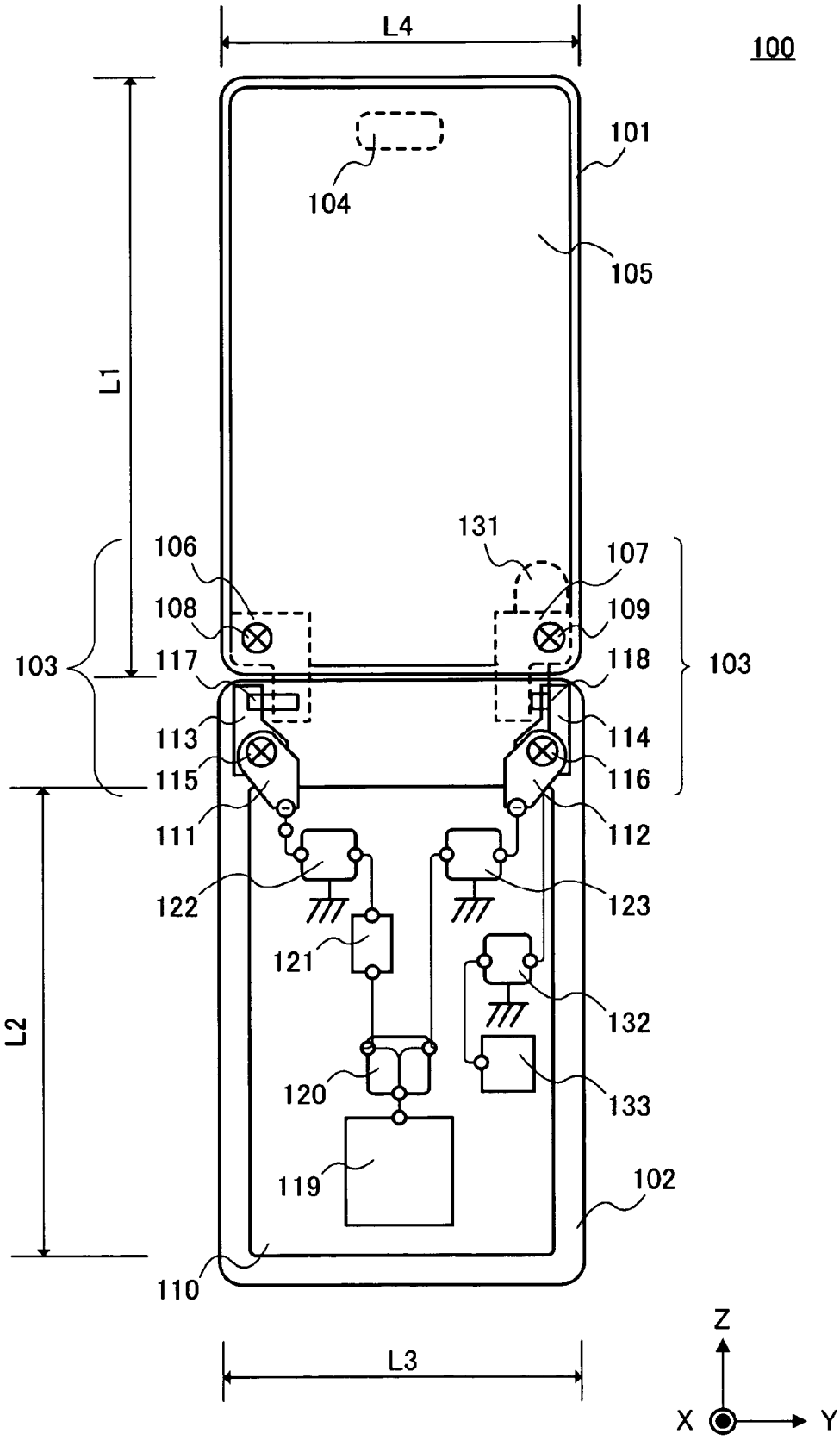
FIG. 1 is a schematic front view of a foldable mobile wireless apparatus according to a first embodiment of the present invention.
Figure 2:
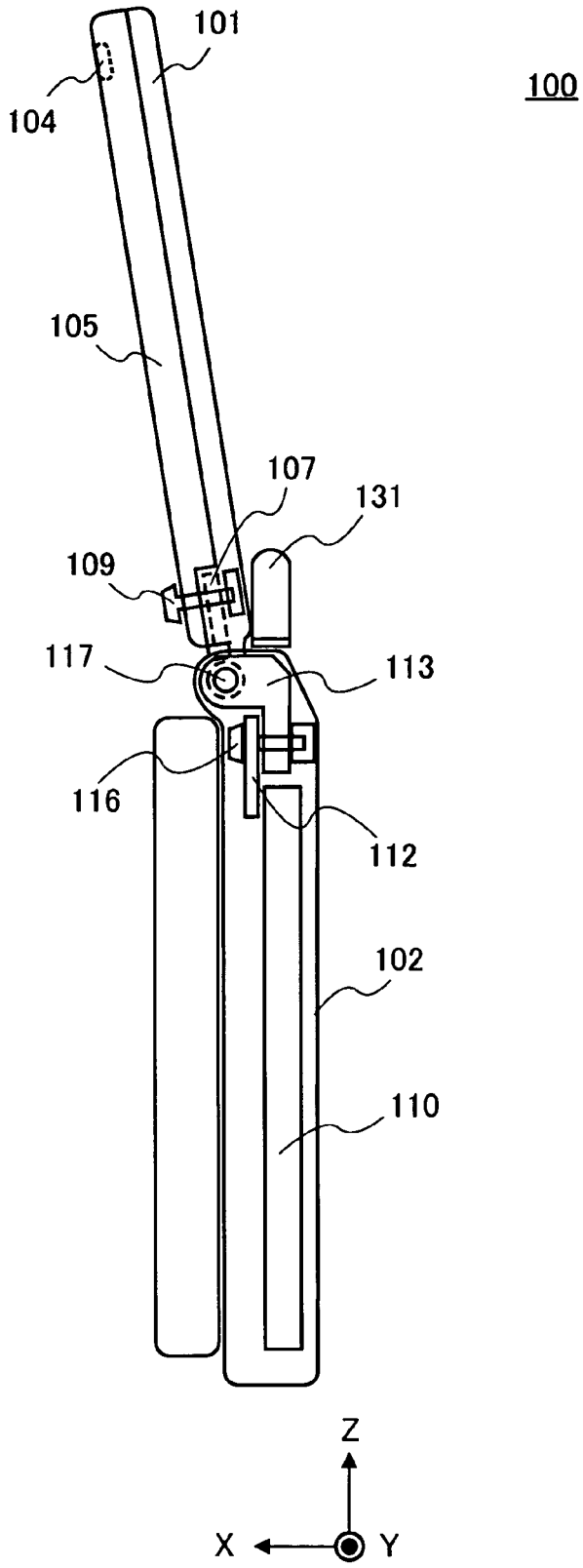
FIG. 2 is a schematic side view of foldable mobile wireless apparatus according to the first embodiment of the present invention.

FIG. 1 is a schematic front view of a foldable mobile wireless apparatus according to a first embodiment of the present invention. FIG. 2 is a schematic side view of foldable mobile wireless apparatus according to the first embodiment of the present invention.

As shown in FIG. 1, foldable mobile wireless apparatus 100 according to the first embodiment of the present invention has upper case 101 and lower case 102. Hinge member 103 connects upper case 101 and lower case 102 and allows upper case 101 and lower case 102 to be opened and closed. Upper case 101 and lower case 102 are made of an insulating resin. Sound hole 104, which is a sound element, is provided in the front side (the X direction side) of upper case 101.

Flat conductor 105 is attached to upper case 101. Flat conductor 105 is made of a light, strong metal having high conductivity (for example, a magnesium alloy). The size of flat conductor 105 is that, for example, long side L1 is 90 mm and short side L4 is about 45 mm. Upper case 101 is provided with a display apparatus (not shown).

At both sides of the lower end of flat conductor 105, hinge fittings 106 and 107 are provided spaced by a predetermined distance. Hinge fittings 106 and 107 are fixed to flat conductor 105 with mounting screws 108 and 109, respectively, mounted in screw holes of upper case 101.

Circuit board 110 is provided inside lower case 102. Feeding terminals 111 and 112 are fixed at both sides of the upper end of circuit board 110. Hinge fittings 113 and 114 are disposed between the upper end of circuit board 110 and the lower end of flat conductor 105. The upper ends of feeding terminals 111 and 112 and the lower ends of hinge fittings 113 and 114 are fixed by mounting screws 115 and 116 mounted in screw holes. Hinge fittings 106 and 107 are rotatably connected to hinge fittings 113 and 114 with rotating shafts 117 and 118, mounted in holes.

Hinge fittings 106, 107, 113 and 114, mounting screws 108, 109, 115 and 116, and rotating shafts 117 and 118 form hinge member 103. Upper case 101 and lower case 102 are connected by hinge member 103 and can be opened and closed. In other words, hinge member 103 makes foldable mobile wireless apparatus 100 foldable.

Hinge fittings 106, 107, 113 and 114, mounting screws 108, 109, 115 and 116, and rotating shafts 117 and 118 are electrically connected. Feeding terminals 111 and 112 are electrically connected to mounting screws 115 and 116 and hinge fittings 113 and 114 in hinge member 103. Accordingly, harmonic signals supplied to feeding terminals 111 and 112 are supplied to hinge fittings 106 and 107.

Radio circuit 119, which is a reception circuit, is provided on circuit board 110. Harmonic signal distributor 120 is connected to radio circuit 119. Phase shifter 121 is connected to one output terminal of harmonic signal distributor 120. Matching circuit 122 is connected between phase shifter 121 and feeding terminal 111. Matching circuit 123 is connected between the other output terminal of harmonic signal distributor 120 and feeding terminal 112. Feeding terminals 111 and 112 are soldered to matching circuits 122 and 123. Feeding terminals 111 and 112 may be connected to matching circuits 122 and 123 with springs.

The size of circuit board 110 is that, for example, long side L2 is 90 mm and short side L3 is about 45 mm. A ground pattern, which provides the ground potential of radio circuit 119, is formed practically all over circuit board 110. The ground terminals of matching circuits 122 and 123 are grounded to the ground pattern on circuit board 110.

A harmonic signal from radio circuit 119 is supplied to harmonic signal distributor 120. Harmonic signal distributor 120 supplies the harmonic signal from radio circuit 119 to matching circuit 122 through phase shifter 121, and to matching circuit 123. Harmonic signal distributor 120 may be formed with, for example, a Wilkinson circuit, and have functions for splitting a high frequency signal from radio circuit 119 to the same amplitude and the same phase. Matching circuits 122 and 123 match the impedance of flat conductor 105 to the circuit impedance of radio circuit 119 (generally, 50Ω).

Phase shifter 121 may be formed with, for example, lumped elements or distributed elements. Phase shifter 121 sets the phase of the high frequency signal supplied to matching circuit 122 to a different value from the phase supplied to matching circuit 123.

Mobile phone antenna 131 is provided in an upper part of lower case 102. Matching circuit 132 for mobile phone antenna 131 and mobile phone radio circuit 133, which is a transmission-reception circuit, are provided on circuit board 110 in lower case 102. Matching circuit 132 is connected to mobile phone radio circuit 133. Mobile phone antenna 131 is connected to matching circuit 132 via hinge member 103. Mobile phone antenna 131 may be provided at the upper end of upper case 101.

The above configuration enables the operation of a dipole antenna where flat conductor 105 and circuit board 110 are supplied power at different phases at both ends in the Y direction.

The operation of the antenna of foldable mobile wireless apparatus 100 having the above configuration will now be described with the operating frequency being set to, for example, 1.575 GHz, which is the frequency of GPS.

Figure 3:
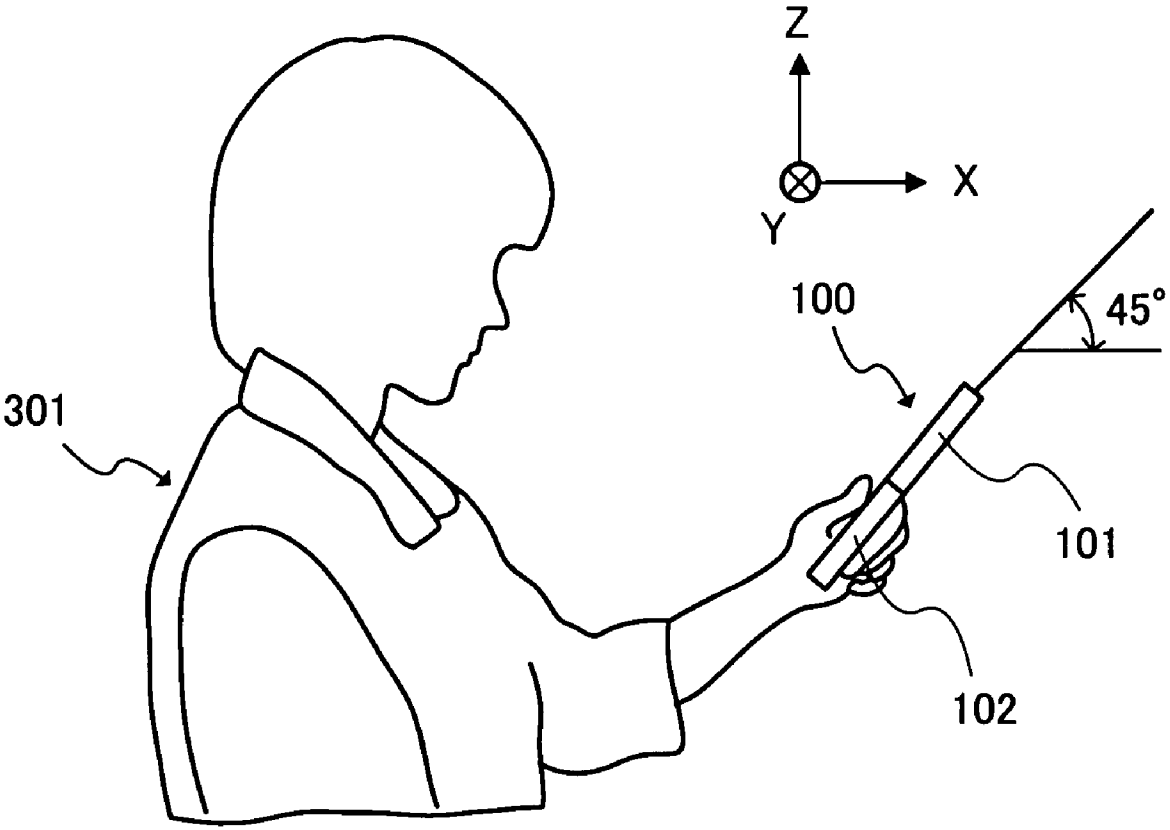
FIG. 3 illustrates a state in which a user operates foldable mobile wireless apparatus according to the first embodiment of the present invention while holding lower case of foldable mobile wireless apparatus in his hand and watching the display screen of foldable mobile wireless apparatus.

The operation of the antenna shown in FIG. 1 will be described with reference to FIGS. 3 and 4. FIG. 3 illustrates a state in which user 301 operates foldable mobile wireless apparatus 100 holding lower case 102 of foldable mobile wireless apparatus 100 in his hand and watching the display screen of foldable mobile wireless apparatus 100.

Figure 4A:
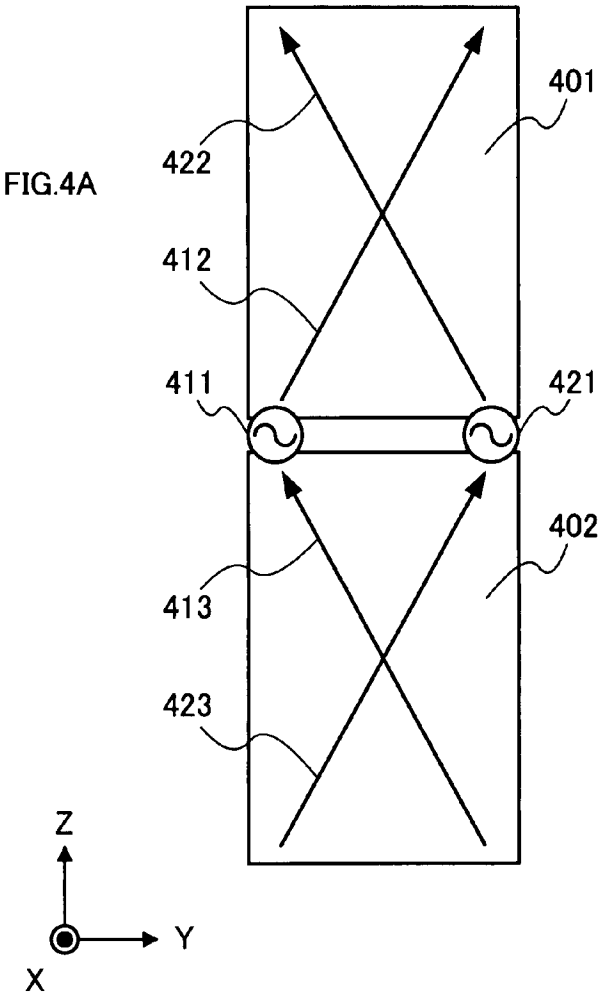
FIG. 4A is an image diagram illustrating an example of antenna current distribution in free space.
Figure 4B:
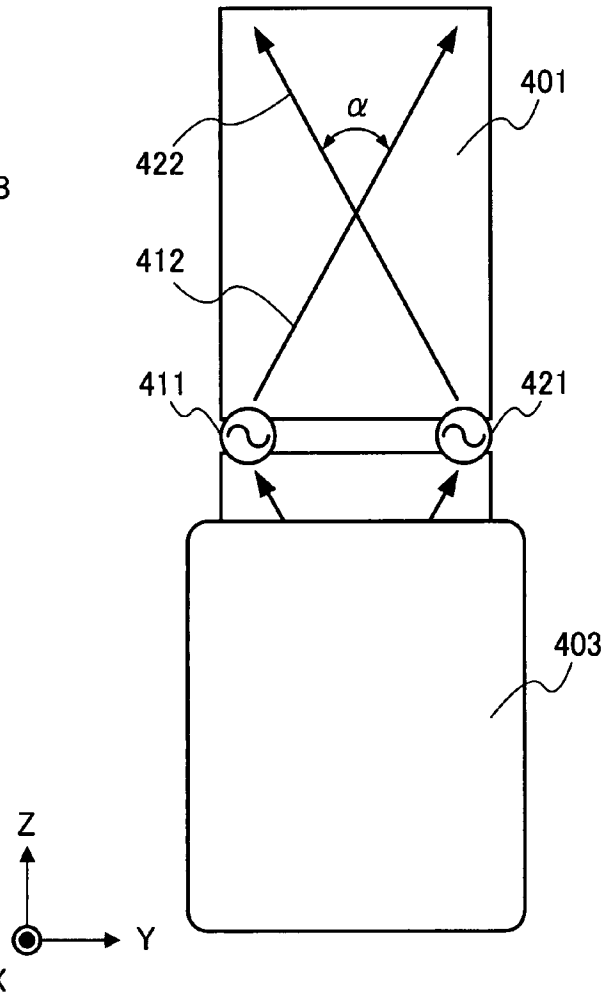
FIG. 4B is an image diagram illustrating an example of the antenna current distribution in the state shown in FIG. 3.

FIG. 4(*a*) is an image diagram illustrating an example of antenna current distribution in free space. FIG. 4(*b*) is an image diagram illustrating an example of antenna current distribution in the hand-holding state shown in FIG. 3. Referring to FIG. 4, dipole elements 401 and 402 model the ground patterns on flat conductor 105 and circuit board 110 in FIG. 1 with rectangular elements to illustrate the antenna operation.

Current vectors 412 and 422 are distributed on the diagonal lines of dipole element 401, and current vectors 413 and 423 are distributed on the diagonal lines of dipole element 402. Current vectors 412, 413, 422 and 423 are modeled on the antenna current distribution on dipole elements 401 and 402 in consideration of the far field radiation in the X direction. Actually, currents having different amplitudes and phases at different positions are concentrated and distributed over the ends of dipole elements 401 and 402.

Current vectors 412 and 413 are components excited by feeding section 411. Current vectors 422 and 423 are components excited by feeding section 421.

The antenna operation in free space will now be described with reference to FIG. 4(*a*). Referring to FIG. 4(*a*), when the far field radiation in the X direction is taken into consideration, current vectors 412 and 413 are synthesized and can be considered to have only the Z-direction component. Similarly, current vectors 422 and 423 can be considered to have only the Z-direction component. Hence, there is no physical angle difference between the current vector components excited by feeding section 411 and feeding section 421.

In contrast, in the hand-held state, as shown in FIG. 4(*b*), dipole element 401 is covered by hand model 403 and so current vectors 413 and 423 are influenced by hand model 403 and do not contribute to the radiation. Accordingly, only current vectors 412 and 422 contribute to the radiation.

In this case, the phenomenon where current vector 412 (422) is synthesized with current vector 413 (423) such as shown in FIG. 4(*a*) does not occur. As a result, angle α (for example, 50 degrees) is formed between the current vector component excited by feeding section 411 and the current vector component excited by feeding section 421.

The phase of the excitation signal of feeding section 411 is advanced with respect to the phase of the excitation signal of feeding section 421 by a predetermined value, so that the radiation of clockwise circularly polarized waves in the X direction is provided. In this situation, by adjusting the phase difference between the excitation signals of feeding sections 411 and 421, it is possible to change the maximum radiation direction or axial characteristics of clockwise circularly polarized wave radiation.

Figure 5:
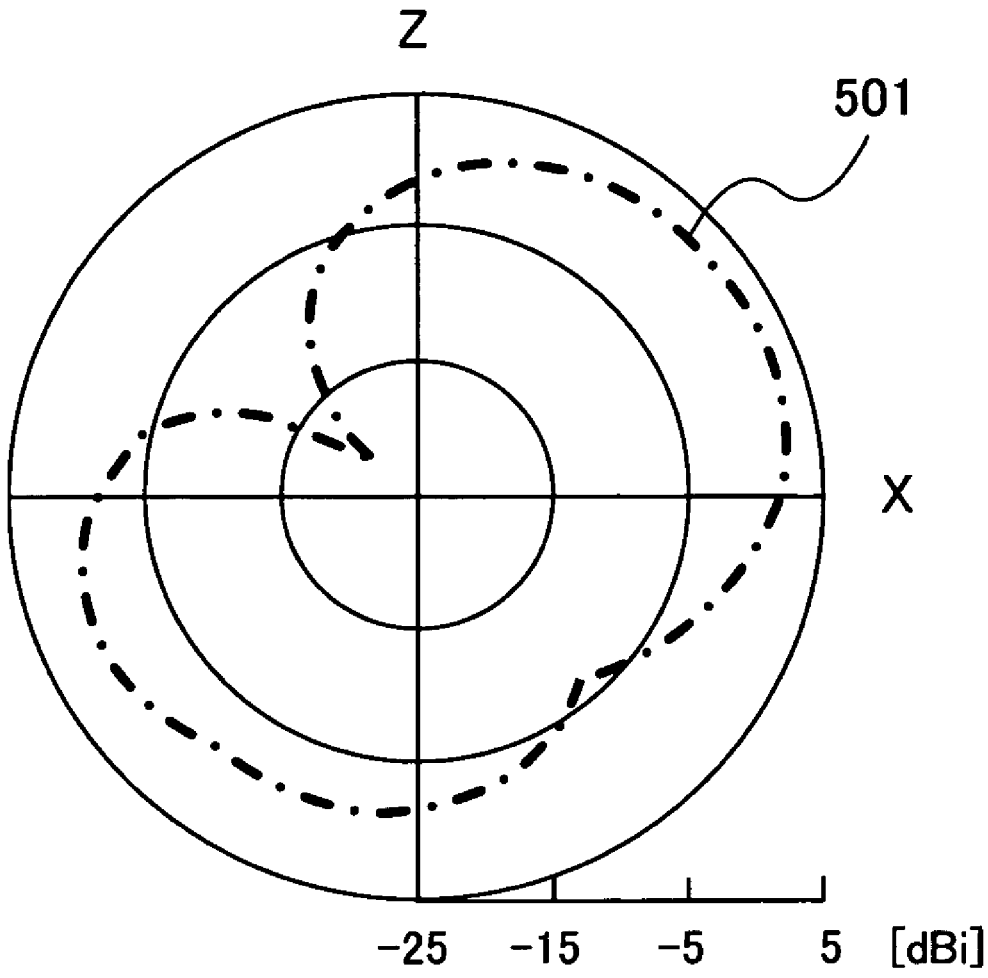
FIG. 5 shows a clockwise circularly polarized wave pattern on the vertical plane in the state shown in FIG. 4(*b*)

For example, by providing a phase difference of 130 degrees (=180 degrees−α) between the excitation signals of feeding sections 411 and 421, the maximum radiation of clockwise circularly polarized waves is provided in the direction inclined 45 degrees to the Z direction from the X direction, as shown in radiation pattern 501 on the X-Z plane in FIG. 5.

As shown in FIG. 3, clockwise circularly polarized waves are generated in the zenithal direction (in the Z direction in FIG. 3) in the state in which foldable mobile wireless apparatus 100 is held at an angle of 45 degrees. Accordingly, the antenna performance appropriate for GPS reception is achieved in the hand-held state.

The antenna elements providing circular polarization characteristics include only one flat conductor 105, and circuit board 110 and hinge member 103, which are essential components. Consequently, it is not necessary to provide additional parts having complicated structures, such as multiple antenna elements and feeding cables, in order to achieve circular polarization characteristics, thereby enabling foldable mobile wireless apparatus 100 to be thinner.

The size and shape of flat conductor 105 and circuit board 110 or the phase difference in supplied currents therebetween are not limited to the ones described above, and it is desirable to appropriately set them in accordance with required antenna performance. Flat conductor 105 may be formed with a metal frame forming part of upper case 101. The components of hinge member 103 may adopt an integrated configuration as long as the feeding system is divided to both ends.

It is desirable to dispose the two feeding systems formed with feeding terminals 111 and 112 and hinge member 103 at both ends in the width direction, although certain advantages may be achieved even if the two feeding systems are disposed in a middle part in the width direction of upper case 101 and lower case 102, as long as the two feeding systems are spaced by a predetermined distance (for example, equal to or longer than about an eighth of the wavelength).

As described above, according to the first embodiment of the present invention, with a simple configuration in which power is supplied with harmonic signals having a predetermined phase difference at both ends of flat conductor 105 and circuit board 110, antenna performance appropriate for GPS reception is achieved in the hand-held state.

Second Embodiment

Figure 6:
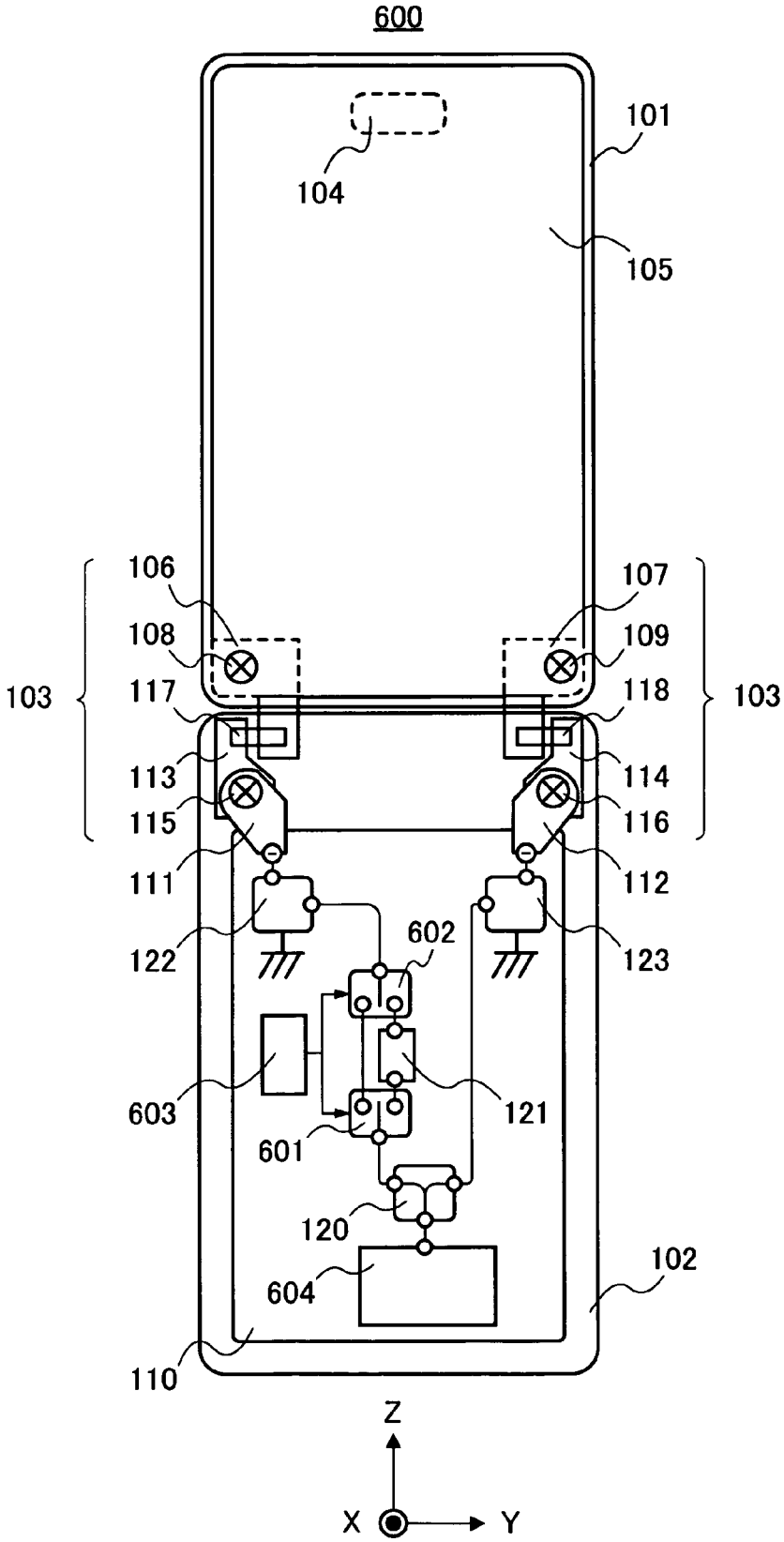
FIG. 6 is a schematic front view of a foldable mobile wireless apparatus according to a second embodiment of the present invention.

A second embodiment of the present invention will now be described in detail with reference to the accompanying drawings. FIG. 6 is a schematic front view of foldable mobile wireless apparatus 600 according to the second embodiment of the present invention. The same reference numerals are used in the second embodiment of the present invention to identify the same components shown in the first embodiment of the present invention. Detailed descriptions of such components will be omitted.

As shown in FIG. 6, foldable mobile wireless apparatus 600 according to the second embodiment of the present invention has switch circuits 601 and 602 and control circuit 603, in addition to the components in the first embodiment of the present invention, and has radio circuit 604, instead of radio circuit 119. Furthermore, mobile phone antenna 131, matching circuit 132, and mobile phone radio circuit 133 are removed. Switch circuits 601 and 602 are connected to the input and output terminals of phase shifter 121, respectively. Control circuit 603 is connected to switch circuits 601 and 602. Radio circuit 604 is formed with a transmission-reception circuit.

Switch circuits 601 and 602 have functions for switching between supplying harmonic signals split by harmonic signal distributor 120 to matching circuit 122 through phase shifter 121 and directly supplying harmonic signals to matching circuit 122 without phase shifter 121.

Control circuit 603 monitors the operation of radio circuit 604 to detect whether foldable mobile wireless apparatus 600 is used in GPS reception mode or in mail transmission-reception mode, and controls switch circuits 601 and 602 in accordance with the result of the detection.

When foldable mobile wireless apparatus 600 is used in GPS reception mode, control circuit 603 controls switch circuits 601 and 602 so as to supply the harmonic signal split at harmonic signal distributor 120 to matching circuit 122 through phase shifter 121. In contrast, when foldable mobile wireless apparatus 600 is used in mail transmission-reception mode, control circuit 603 controls switch circuits 601 and 602 so as to directly supply the harmonic signal split at harmonic signal distributor 120 to matching circuit 122 without phase shifter 121.

As a result, the phase of the harmonic signal (high frequency signal) supplied to matching circuit 122 is switched to a different value (i.e. phased power supply) or the same value (i.e. in-phase power supply) with respect to the phase of the harmonic signal (high frequency signal) supplied to matching circuit 123.

Consequently, in the hand-held state shown in FIG. 3, polarization characteristics vary depending on whether the user uses the mobile phone in GPS reception mode or in mail transmission-reception mode, which is one function of the mobile phone.

The operation of the antenna of foldable mobile wireless apparatus 600 according to the second embodiment of the present invention will be described next.

Referring to FIG. 6, since control circuit 603 controls switch circuits 601 and 602 so as to supply the harmonic signal split by harmonic signal distributor 120 to matching circuit 122 through phase shifter 121 when foldable mobile wireless apparatus 600 is used in GPS reception mode, the same advantage can be achieved as with the first embodiment of the present invention.

On the other hand, since control circuit 603 controls switch circuits 601 and 602 so as to directly supply the harmonic signal split by harmonic signal distributor 120 to matching circuit 122 when foldable mobile wireless apparatus 600 is used in mail transmission-reception mode, so that the phases of the harmonic signals supplied to matching circuits 122 and 123 are synchronize. Referring FIG. 4(*b*), in the hand-held state, only the current flowing in upper case 401 contributes to the far field radiation in the X direction. Current vectors 412 and 422 excited by feeding sections 411 and 421 are synthesized at the same phase, thereby reinforcing the current vector component in the Z direction.

In this state, the vertical polarized wave component is increased with foldable mobile wireless apparatus 600 being held at an angle of 45 degrees, as in the example shown in FIG. 3.

Generally, the pattern averaged gain (PAG) represented by following Equation (1) is used as an index indicating the effective antenna performance in the calling state of the foldable mobile wireless apparatus.

$$PAG = \frac{1}{2\pi}\int_0^{2\pi}\left[G_\theta\left(\frac{\pi}{2}, \phi\right) + \frac{1}{C_{VH}}G_\phi\left(\frac{\pi}{2}, \phi\right)\right]d\phi \qquad \text{[Equation 1]}$$

In Equation (1), "$G_\theta(\phi)$" and "$G_\phi(\phi)$" are the harmonic signal directivities on the horizontal plane of the vertical polarized wave component and the horizontal polarized wave component, respectively. "CVH" is a correction coefficient associated with the cross polarized harmonic wave ratio of incoming waves arriving at the antenna (the ratio of the harmonic signal of the vertical polarized wave component to the horizontal polarized wave component). It is known that the cross polarization ratio is generally in a range from 4 dB to 9 dB in the multiplex-wave environment of land mobile communication. This indicates that the harmonic signal of the vertical polarized wave of an incoming wave is 4 dB to 9 dB higher than the harmonic signal of the horizontal polarized wave.

Accordingly, Equation (1) means that the vertical polarized wave component is weighted to average the harmonic signal directivities on the horizontal plane. It is hereinafter assumed that "CVH" is 9 dB. With the antenna for mobile wireless apparatus, increasing the level of the vertical polarized wave component while in use gives a higher PAG.

According to the second embodiment of the present invention, the vertical component increases when power is supplied to the two feeding sections at the same phase, and, as a result, high PAG (around −4 dB) can be achieved. Hence, according to the second embodiment of the present invention, by controlling the phase shift between the two feeding sections, one antenna can be used as a mobile phone antenna and as a circularly polarized wave antenna, and, furthermore, optimal polarization characteristics can be achieved in accordance with the state of use of foldable mobile wireless apparatus 600. In addition, according to the second embodiment of the present invention, by using one antenna as a mobile phone antenna and as a GPS antenna, foldable mobile wireless apparatus 600 can be made smaller and thinner.

Although a configuration has been described with the second embodiment of the present invention where the phase of the harmonic signal supplied to the −Y side is changed, the same advantage can be achieved with a configuration where the changed is made to the supply to the Y side or with a configuration where the phases of harmonic signals at the two feeding sections are changed together.

Third Embodiment

Figure 7:
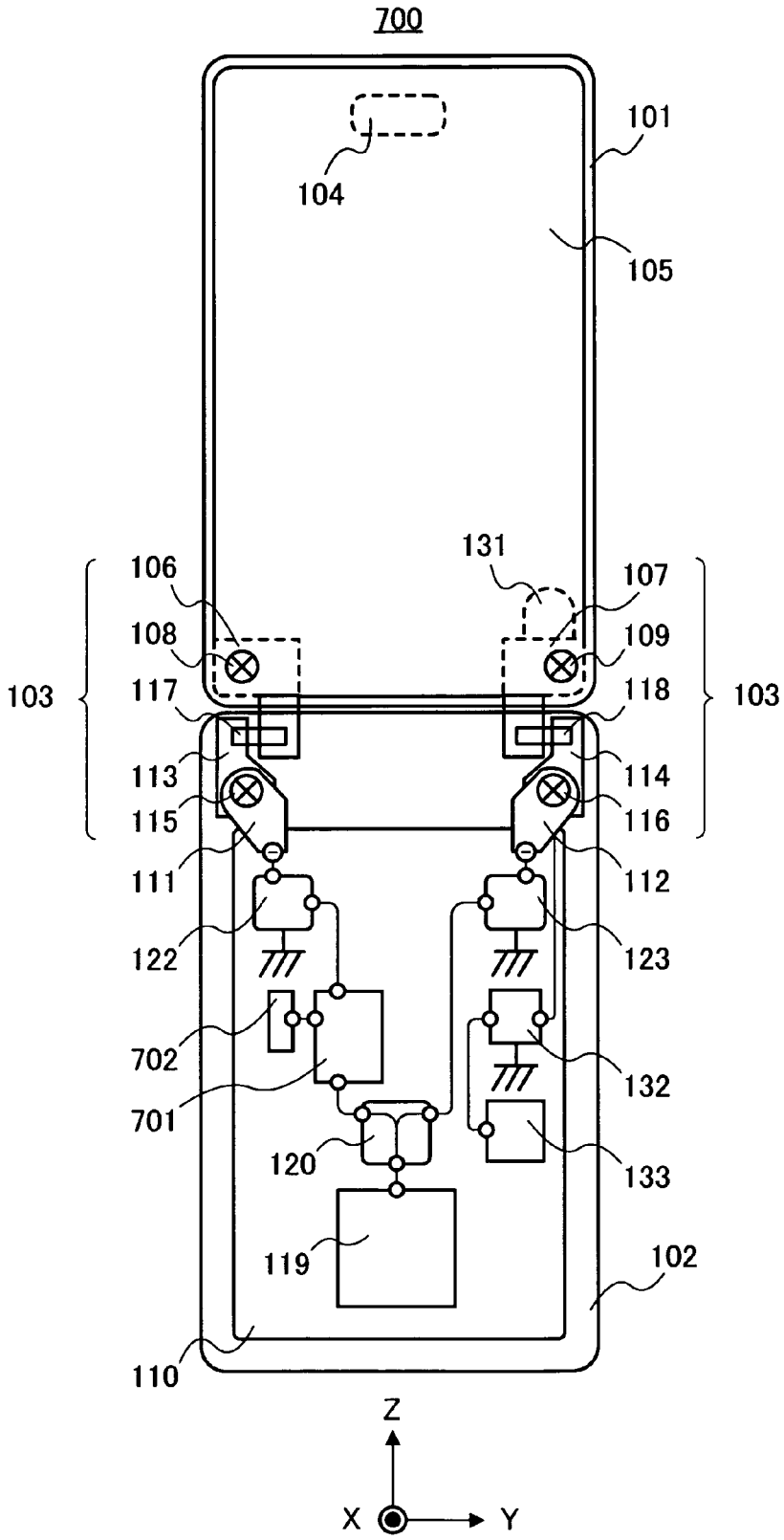
FIG. 7 is a schematic front view of a foldable mobile wireless apparatus according to a third embodiment of the present invention.

A third embodiment of the present invention will now be described in detail with reference to the accompanying drawings. FIG. 7 is a schematic front view of foldable mobile wireless apparatus 700 according to the third embodiment of the present invention. The same reference numerals are used in the third embodiment of the present invention to identify the same components shown in the first embodiment of the present invention. Detailed descriptions of such components will be omitted.

As shown in FIG. 7, foldable mobile wireless apparatus 700 according to the third embodiment of the present invention has, with respect to the first embodiment of the present invention, phase difference control circuit 701 instead of phase shifter 121 and adds inclination angle sensor 702. Inclination angle sensor 702 is connected to phase difference control circuit 701.

Inclination angle sensor 702 detects the inclination angle of foldable mobile wireless apparatus 700 and generates a value of the detected inclination angle and supplies the generated value to phase difference control circuit 701. Inclination angle sensor 702 is formed with, for example, a triaxial gyro sensor. Inclination angle sensor 702 detects the inclination angle of foldable mobile wireless apparatus 700 in three-dimensional space and generates the value of the detected inclination angle.

Phase difference control circuit 701 controls the phase difference between the harmonic signals supplied to the two feeding terminals 111 and 112 in accordance with the value of the inclination angle detected by inclination angle sensor 702.

The third embodiment of the present invention is applicable to the second embodiment of the present invention.

As described above, according to the third embodiment of the present invention, since the polarized waves can be optimized in accordance with the inclination angle of foldable mobile wireless apparatus 700, which varies depending on the state of use of foldable mobile wireless apparatus 700, it is possible to always ensure high antenna performance.

Fourth Embodiment

Figure 8:
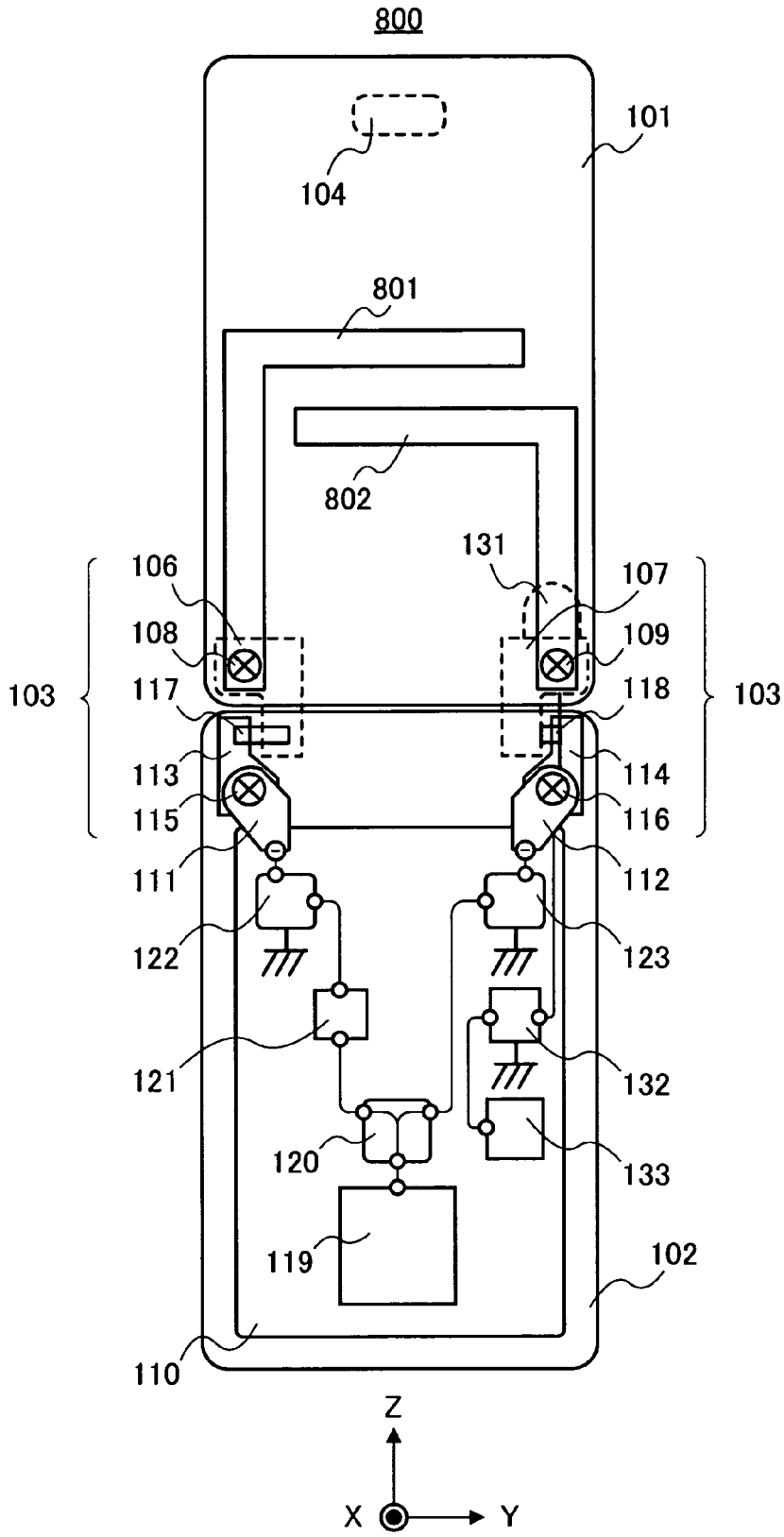
FIG. 8 is a schematic front view of a foldable mobile wireless apparatus according to a fourth embodiment of the present invention.

A fourth embodiment of the present invention will now be described in detail with reference to the accompanying drawings. FIG. 8 is a schematic front view of foldable mobile wireless apparatus 800 according to the fourth embodiment of the present invention. The same reference numerals are used in the fourth embodiment of the present invention to identify the same components shown in the first embodiment of the present invention. Detailed descriptions of such components will be omitted.

As shown in FIG. 8, foldable mobile wireless apparatus 800 according to the fourth embodiment of the present invention has, with respect to the first embodiment, L-shaped conductor 801 and L-shaped conductor 802, instead of flat conductor 105.

L-shaped conductor 801 and L-shaped conductor 802 are spaced by a predetermined distance in upper case 101 and are arranged so as to have different main polarized wave directions. L-shaped conductors 801 and 802 are fixed to hinge fittings 106 and 107 with mounting screws 108 and 109, mounted in screw holes of upper case 101.

The operation of the antenna of foldable mobile wireless apparatus 800 according to the fourth embodiment of the present invention, shown in FIG. 8, can be described using current vectors modeling current distribution on antenna elements in consideration of the far field radiation, as in the operation of the antenna shown in FIG. 1.

Using the above model, the current distributed on L-shaped conductor 801 can be modeled with current vectors distributed on lines connecting the feeding section and the tip of L-shaped conductor 801. The current distributed over L-shaped conductor 802 can also be similarly modeled.

The phase of an excitation signal of L-shaped conductor 801 is advanced with respect to the phase of an excitation signal of L-shaped conductor 802 by a predetermined value, so that clockwise circularly polarized waves are provided in the X direction side. In this situation, by adjusting the phase difference between the excitation signals of L-shaped conductors 801 and 802, it is possible to change the maximum radiation direction or axial characteristics of clockwise circularly polarized wave radiation.

The components forming the antenna elements providing circular polarization characteristics include only L-shaped conductors 801 and 802, and circuit board 110 and hinge member 103, which are essential components, thus eliminating the need for parts including feeding cables.

Although both antenna elements (L-shaped conductors 801 and 802) are L-shaped in the fourth embodiment of the present invention, similar characteristics can be achieved even if the angle making the L-shape is not 90 degrees. In addition, with the fourth embodiment of the present invention, even if both antenna elements have linear shapes, instead of L-shapes, as long as the antenna elements are disposed so as to have different main polarized wave directions, the same advantage can be achieved. Furthermore, the same advantage can be achieved in the fourth embodiment of the present invention even if both antenna elements have cursive shapes, instead of linear shapes, as long as the antenna elements are disposed so as to have different main polarization directions.

The fourth embodiment of the present invention is applicable to the second and third embodiments of the present invention.

Foldable mobile wireless apparatus 800 according to the fourth embodiment of the present invention can provide not only circularly polarized waves but also linearly polarized waves used in communication with foldable mobile wireless apparatus 800, by adjusting the phase difference of excitation signals between two antenna elements. For example, with foldable mobile wireless apparatus 800, when power is supplied to the both antenna elements at the same phase, the vertical polarized wave component increases and high PAG can be achieved in the state of use for mail such as shown in FIG. 3.

In contrast, with foldable mobile wireless apparatus 800, when power is supplied to the both antenna elements at reverse phases, the horizontal polarized wave component increases. Generally, since the mobile phone is likely to be held at an inclination of about 60 degrees in the calling state in which the user makes a call while holding foldable mobile wireless apparatus (foldable mobile phone) in his left or right hand and making foldable mobile wireless apparatus (foldable mobile phone) close to his ear and mouth, the horizontal polarized wave component in free space becomes the vertical polarized wave component in the calling state. Accordingly, with foldable mobile wireless apparatus 800, by supplying power to the both antennas at reverse phases and increasing the horizontal polarized wave component, the vertical polarized wave component is reinforced in the calling state, so that high PAG can be achieved.

Consequently, according to the fourth embodiment of the present invention, by appropriately controlling the phase difference in excitation signals between the two antenna elements, the antenna elements can be used as a mobile phone antenna and as a circularly polarized wave antenna, so that it is possible to make foldable mobile wireless apparatus 800 smaller and provide optimal polarization characteristics in accordance with the state of use of foldable mobile wireless apparatus 800.

According to a first aspect of the present invention, a foldable mobile wireless has an upper case and a lower case, the upper case and lower case being connected by a hinge member and able to be opened and closed, and this foldable mobile wireless apparatus employs a configuration having: a flat conductor that is provided in the upper case; a first feeding section and a second feeding section that are provided on the flat conductor spaced by a predetermined distance; a circuit board that is provided in the lower case; a harmonic signal distributing section that is provided on the circuit board and distributes a harmonic signal to the first feeding section and the second feeding section; a harmonic signal supplying section that supplies the harmonic signal to the harmonic signal distributing section; and a phase setting section that sets an excitation phase of the harmonic signal at the second feeding section to a different value from an excitation phase of the harmonic signal at the first feeding section.

With this configuration, it is possible to provide a thin, foldable mobile wireless apparatus that does not require complicated configurations formed with multiple antennas and feeding cables for circularly polarized wave antennas for mobile phones, and that provides high antenna performance in the hand-held state.

According to a second aspect of the present invention, the foldable mobile wireless apparatus of the first aspect of the present invention further includes a phase difference controlling section that controls a phase difference between the harmonic signal excited by the first feeding section and the harmonic signal excited by the second feeding section.

With this configuration, in addition to the advantage of the first aspect of the present invention, it is possible to provide a thin, foldable mobile wireless apparatus that uses one antenna mounted in the foldable mobile wireless apparatus as a mobile phone antenna and as a circularly polarized wave antenna, and that provides high antenna performance in the hand-held state.

According to a third aspect of the present invention, the foldable mobile wireless apparatus according to the first aspect of the present invention further includes an inclination angle detection section that detects an inclination angle of the foldable mobile wireless apparatus and generates a value of the detected inclination angle, and, in this foldable mobile wireless apparatus, the phase difference controlling section controls the phase difference in accordance with the value of the inclination angle detected by the inclination angle detection section.

With this configuration, in addition to the advantage of the first aspect of the present invention, it is possible to provide optimal polarization characteristics in accordance with the inclination angle of the foldable mobile wireless apparatus.

According to a fourth aspect of the present invention, a foldable mobile wireless apparatus has an upper case and a lower case, the upper case and lower case being connected by a hinge member and able to be opened and closed, and this foldable mobile wireless apparatus employs a configuration having: a first conductor and a second conductor that are arranged in the upper case spaced by a predetermined distance such that main polarized wave directions differ; a first feeding section and a second feeding section that are provided on the first conductor and the second conductor; a circuit board that is provided in the lower case; a harmonic signal distributing section that is provided on the circuit board and distributes a harmonic signal to the first feeding section and the second feeding section; a harmonic signal supplying section that supplies the harmonic signal to the harmonic signal distributing section; and a phase setting section that sets an excitation phase of the harmonic signal at the second feeding section to a different value from an excitation phase of the harmonic signal at the first feeding section.

With this configuration, it is possible to provide a thin, foldable mobile wireless apparatus that does not require complicated configurations formed with multiple antennas and feeding cables for circularly polarized wave antennas for mobile phones, and that provides high antenna performance in the hand-held state.

The present application is based on Japanese Patent Application No. 2004-130328 filed on Apr. 26, 2004, the entire content of which is incorporated herein by reference.

INDUSTRIAL APPLICABILITY

The present invention is suitable for use in a thin, foldable mobile wireless apparatus that does not require complicated configurations formed with multiple antennas and feeding cables for circularly polarized wave antennas for mobile phones, and that provides high antenna performance in the hand-held state.

The invention claimed is:

1. A foldable mobile wireless apparatus having an upper case and a lower case, said upper case and lower case being connected by a hinge member and able to be opened and closed, the foldable mobile wireless apparatus comprising:

a flat conductor that is provided in the upper case;

a hinge section that has conductivity and is electrically connected to the flat conductor;

a circuit board that is provided in the lower case;

a first feeding section and a second feeding section that are provided and spaced by a predetermined distance in a width direction in the hinge section, and that supply power from the circuit board to the flat conductor via the hinge section;

a harmonic signal distributing section that is provided on the circuit board and distributes a harmonic signal to the first feeding section and the second feeding section;

a harmonic signal supplying section that supplies the harmonic signal to the harmonic signal distributing section;

a phase setting section that sets an excitation phase of the harmonic signal at the second feeding section to a different value from an excitation phase of the harmonic signal at the first feeding section;

a phase difference controlling section that controls the phase difference between the excitation phase of the harmonic signal at the first feeding section and the excitation phase of the harmonic signal at the second feeding section; and an inclination angle detection section that detects an inclination angle of the foldable mobile wireless apparatus and generates a value of the detected inclination angle, wherein:

the phase difference controlling section controls the phase difference by switching between a phased power supply and an in-phase power supply in accordance with a GPS reception mode for a GPS receiving function and a mail transmission-reception mode which is one function of the mobile wireless apparatus, and controls the phase difference in accordance with the value of the inclination angle detected by the inclination angle detection section.

2. A foldable mobile wireless apparatus having an upper case and a lower case, said upper case and lower case being connected by a hinge member and able to be opened and closed, the foldable mobile wireless apparatus comprising:

a first conductor and a second conductor that are spaced by a predetermined distance in the upper case and arranged such that main polarized wave directions differ;

a hinge section that has conductivity and is electrically connected to the first conductor and the second conductor;

a circuit board that is provided in the lower case;

a first feeding section and a second feeding section that are provided and spaced by a predetermined distance in a width direction in the hinge section, and that supply power from the circuit board to the first conductor and the second conductor via the hinge section;

a harmonic signal distributing section that is provided on the circuit board and distributes a harmonic signal to the first feeding section and the second feeding section;

a harmonic signal supplying section that supplies the harmonic signal to the harmonic signal distributing section;

a phase setting section that sets an excitation phase of the harmonic signal at the second feeding section to a different value from an excitation phase of the harmonic signal at the first feeding section;

a phase difference controlling section that controls the phase difference between the excitation phase of the harmonic signal at the first feeding section and the excitation phase of the harmonic signal at the second feeding section; and an inclination angle detection section that detects an inclination angle of the foldable mobile wireless apparatus and generates a value of the detected inclination angle, wherein:

the phase difference controlling section controls the phase difference by switching between a phased power supply and an in-phase power supply in accordance with a GPS reception mode for a GPS receiving function and a mail transmission-reception mode which is one function of the mobile wireless apparatus, and controls the phase difference in accordance with the value of the inclination angle detected by the inclination angle detection section.

3. The foldable mobile wireless apparatus according to claim 1, wherein:

the phase difference controlling section comprises:

switch circuits that are connected to input and output terminals of the phase setting section; and a control circuit that controls the switch circuits, and the control circuit controls the switch circuits such that the harmonic signal is supplied via the phase setting section in the GPS reception mode, and the harmonic signal is supplied not via the phase setting section in the mail transmission-reception mode.

* * * * *